US011000931B2

(12) United States Patent
Hettler et al.

(10) Patent No.: US 11,000,931 B2
(45) Date of Patent: May 11, 2021

(54) GRINDING MACHINE

(71) Applicant: Mahle International GmbH, Stuttgart (DE)

(72) Inventors: Michael Hettler, Pluderhausen (DE); Roland Schacherer, Geisingen (DE)

(73) Assignee: Mahle International GmbH

( * ) Notice: Subject to any disclaimer, the term of this patent is extended or adjusted under 35 U.S.C. 154(b) by 198 days.

(21) Appl. No.: 15/089,420

(22) Filed: Apr. 1, 2016

(65) Prior Publication Data

US 2016/0288286 A1 Oct. 6, 2016

(30) Foreign Application Priority Data

Apr. 2, 2015 (DE) ..... 10 2015 206 082.9

(51) Int. Cl.

| | |
|---|---|
| ***B24B 1/00*** | (2006.01) |
| ***B24B 5/01*** | (2006.01) |
| ***B24B 5/307*** | (2006.01) |
| ***B24B 5/42*** | (2006.01) |
| ***B24B 5/02*** | (2006.01) |
| ***B24B 5/22*** | (2006.01) |
| ***B24B 5/04*** | (2006.01) |

(52) U.S. Cl.

CPC ..... *B24B 1/00* (2013.01); *B24B 5/01* (2013.01); *B24B 5/02* (2013.01); *B24B 5/04* (2013.01); *B24B 5/22* (2013.01); *B24B 5/307* (2013.01); *B24B 5/42* (2013.01)

(58) Field of Classification Search

CPC .... B24B 5/01; B24B 5/04; B24B 5/16; B24B 5/22; B24B 5/26; B24B 5/28; B24B 5/307; B24B 5/42; B24B 5/421; B24B 27/0076; B24B 1/00; B24B 5/02; B24B 5/18

USPC ..... 451/49, 242, 246, 249, 251, 399

See application file for complete search history.

(56) References Cited

U.S. PATENT DOCUMENTS 1,736,967 A * 11/1929 Fraser ..... B24B 5/04 144/245.1
2,897,636 A * 8/1959 Pyne ..... B24B 5/307 451/244

(Continued)

FOREIGN PATENT DOCUMENTS

DE 233336 A1 2/1986
DE 102007023894 A1 11/2008

(Continued)

OTHER PUBLICATIONS

English abstract for DE-102007023894-A1.

(Continued)

*Primary Examiner* — Eileen P Morgan
*Assistant Examiner* — Marcel T Dion
(74) *Attorney, Agent, or Firm* — Fishman Stewart PLLC

(57) ABSTRACT

A grinding machine for external cylindrical grinding of hollow shafts may include at least one grinding disc, at least one support disc, and at least two centrings for a face-side fixing of a hollow shaft. At least one of the at least two centrings may be configured as a point. A ruler may be arranged to adjust and hold a position of the hollow shaft during a grinding operation. A rotation axis of the at least one grinding disc and of the at least one support disc may be arranged parallel to one another and define a plane. A rotation axis of the hollow shaft to be ground may extend outside of the plane by a distance of a>12 mm.

18 Claims, 2 Drawing Sheets

(56) References Cited

U.S. PATENT DOCUMENTS

| | | | | |
|---|---|---|---|---|
| 4,932,642 | A * | 6/1990 | Salenbien | B23B 31/02 269/133 |
| 5,643,051 | A | 7/1997 | Zhou et al. | |
| 5,681,208 | A * | 10/1997 | Junker | B23B 31/22 451/381 |
| 5,862,280 | A * | 1/1999 | Tanaka | B24B 5/04 385/60 |
| 7,631,856 | B2 * | 12/2009 | Zhang | B23B 31/4066 269/48.1 |
| 8,100,738 | B2 | 1/2012 | Tschudin | |
| 2003/0213128 | A1 * | 11/2003 | Kaimi | B24B 5/04 29/898.02 |
| 2004/0248502 | A1 * | 12/2004 | Junker | B24B 5/421 451/11 |
| 2005/0078893 | A1 * | 4/2005 | Furuta | B24B 5/22 384/100 |
| 2010/0203805 | A1 * | 8/2010 | Junker | B24B 5/42 451/5 |
| 2012/0238187 | A1 * | 9/2012 | Himmelsbach | B24B 1/00 451/49 |
| 2013/0045665 | A1 * | 2/2013 | Schmitz | B24B 27/0076 451/160 |
| 2015/0246422 | A1 * | 9/2015 | Himmelsbach | B24B 5/42 451/249 |
| 2016/0243671 | A1 * | 8/2016 | Holiness-Stalling | B24B 41/04 |
| 2017/0252886 | A1 * | 9/2017 | Junker | B24B 27/0061 |

FOREIGN PATENT DOCUMENTS

| | | | |
|---|---|---|---|
| DE | 102008045842 | A1 | 3/2010 |
| DE | 102011110118 | A1 | 2/2013 |
| DE | 102013214226 | A1 | 1/2015 |
| EP | 1955808 | A1 | 8/2008 |
| GB | 308874 | A | 4/1929 |

OTHER PUBLICATIONS

English abstract for DE-102008045842-A1.

A Bibliographic data sheet indicating no abstract available for DD-233336-A1.

German Search Report 10 2015 206 082.9, dated Mar. 14, 2016.

English abstract for DE-102013214226.

* cited by examiner

GRINDING MACHINE

CROSS-REFERENCE TO RELATED APPLICATIONS

This application claims priority to German Patent Application No. 10 2015 206 082.9, filed Apr. 2, 2015, the contents of which are hereby incorporated by reference in its entirety.

TECHNICAL FIELD

The present invention relates to a grinding machine for the external cylindrical grinding of hollow shafts, in particular of camshafts. The invention furthermore relates to a method for the external cylindrical grinding of hollow shafts.

BACKGROUND

From EP 1 955 808 A1 a generic grinding machine is known for the external cylindrical grinding of hollow shafts with at least one grinding disc and a support disc and two centrings for the face-side fixing of the hollow shaft during the grinding. The drive axis of the support disc, of the grinding disc and of the hollow shaft which is to be ground are aligned parallel here. The drive of the support disc serves for the driving of the hollow shaft during grinding. In addition, for grinding, a means is present for measuring the contact pressure of the support disc onto the hollow shaft, in particular a pressure sensor. Hereby, advantages of the grinding between points are to be combined in a simple manner with those of centreless grinding.

From DE 10 2013 214 226 A1 a method is known for the centreless grinding of shaft parts, in which the shaft part which is to be ground, having axial centrings at its face sides, is ground in a rotatably driven manner in a conventional manner in centreless grinding at a distance between grinding disc and support disc. The grinding disc and the support disc have a width which corresponds at least to the length of the shaft part which is to be ground. The shaft part is firstly ground at its end regions concentrically to the centrings, so that ground sections formed concentrically to the centrings are produced. This is followed by the grinding of the intermediate region lying between the end regions, followed by a dimensionally stable and geometrically accurate grinding of the complete shaft part to finished size on the basis of the ground sections at the end regions of the shaft part carried out concentrically to the centrings, resting on a support ruler.

SUMMARY

The present invention is concerned with the problem of indicating for a grinding machine of the generic type an improved or at least an alternative embodiment which in particular enables a distinctly more precise cylindrical grinding.

This problem is solved according to the invention by the subject of the independent claim(s). Advantageous embodiments are the subject of the dependent claims.

The present invention is based on the general idea of indicating a grinding machine, by means of which an external cylindrical grinding of a hollow shaft between two centrings is made possible, wherein the arrangement of the grinding discs corresponds to that of a grinding machine for centreless grinding. Here, one of these centrings can be constructed as a centring stopper and can engage into the hollow shaft. In contrast to grinding machines known from the prior art, by means of which a hollow shaft is ground between two points, or in which the hollow shaft is ground in a centreless manner between a grinding disc and a support disc, in the grinding machine according to the invention, the hollow shaft is therefore held between points and at the same time, as in an arrangement for centreless grinding, is ground between a grinding disc and support disc. Therefore, the hollow shaft which is to be ground is actually statically overdetermined. So that a grinding becomes possible at all, on the one hand the elasticity resulting through the hollow shaft, and on the other hand the supporting force resulting through the support disc, must be coordinated with one another so that grinding can take place with a high degree of accuracy.

In addition, in an advantageous further development of the invention, the hollow shaft can be grasped on one side not on the chamfer, but in the interior diameter, such as for example by a stopper which is later added. Hereby, the coaxiality is, moreover, ground extremely accurately to a stopper which is later to be placed. In contrast to grinding machines known from the prior art, the grinding machine according to the invention has, furthermore, a ruler for adjusting or respectively supporting the position of the hollow shaft before or respectively during the grinding, wherein the grinding machine in addition is constructed such that an eccentric grinding of the hollow shaft in relation to the two parallel rotation axes of the grinding disc and the support disc becomes possible. For a particularly high degree of precision during grinding, the processing of the hollow shaft should take place in a region which lies outside, in particular over, the axes of the grinding disc and of the support disc. It applies here that the higher one is able to grind, all the higher is the grinding accuracy which is able to be achieved. With the use of a ruler, the hollow shaft can be, for example, firstly scaled roughly and then pushed into the final grinding position. The ruler can, however, also be used only for the additional support of the hollow shaft, and delivers only the amount ground off by the grinding disc. It has been found here that with a grinding of the hollow shaft with a distance of the rotation axis of the hollow shaft which is to be ground from a plane formed by the two rotation axes of the grinding disc and of the support disc of greater than 12 mm, in particular 15-17 mm is particularly advantageous. This high grinding position can be made possible through the simultaneous receiving of the hollow shaft in points. However, this distance can not be selected to be of an arbitrary size, because starting from a certain position the achievable accuracy also decreases again. The grinding itself takes place here in the grinding machine according to the invention through a synchronous delivery of grinding disc, support disc and ruler, whereby consistent system parameters can be achieved and the hollow shaft can be ground extremely precisely. In particular, a high true running accuracy can be achieved without loss of the centre, so that pre-processed functional sections, such as for example a thread, still run centrally to the ground shafts after the grinding process.

In an advantageous further development of the solution according to the invention, the grinding disc and the support disc are able to be delivered to the hollow shaft. Hereby, it is possible to cylindrically grind hollow shafts with different external diameters in one and the same grinding machine, or respectively to enable the delivery to the final dimension of the hollow shaft. Through the delivery speed, also, a differentiation can be additionally made between a roughing and finishing.

Expediently, the hollow shaft is adjustable by means of the ruler orthogonally to the plane or respectively the ruler readjusts by the amount which was ground off on the hollow shaft.

In an advantageous further development of the solution according to the invention, the support disc extends only over a length $l_1$ of approximately 30-80% of the total length $l_2$ of the hollow shaft. During the grinding, the hollow shaft is fixed between the centring stopper and the opposite centring and is supported by the grinding disc and the support disc. When a grinding and a simultaneous supporting by the adjustable ruler, provided according to the invention, takes place, the entire system would actually be statically overdetermined. So that during the grinding process sufficient elasticity is nevertheless present in the system, the support of the hollow shaft through the support disc or respectively the ruler does not take place on the entire length of the hollow shaft, as is otherwise usual, but exclusively in a partial region of approximately 30-80% of the total length of the hollow shaft. This and the elasticity resulting through the tube construction of the hollow shaft are able to be controlled without difficulty here with the setting of suitable parameters.

In a further advantageous embodiment of the grinding machine according to the invention, a drive of the hollow shaft takes place via the centring, in particular via an axial contact pressure, or via a carrier arranged on the centring, which carrier cooperates in a form-fitting manner with the hollow shaft or with a stopper arranged thereon. Alternatively, of course, the drive of the hollow shaft for grinding can also take place via the centring stopper arranged opposite the centring. Particularly the form-fitting cooperation between the centring stopper or respectively the centring and the hollow shaft or respectively a stopper arranged therein, can enable a loss-free torque transmission, in particular without friction losses. The centring stopper here can again be connected in a form- and/or force-fitting manner with the hollow shaft.

In a further advantageous embodiment of the solution according to the invention, at least one further grinding disc is provided for the external cylindrical grinding of a stopper joined with the hollow shaft. Therefore, with a first grinding disc for example the hollow shaft can be ground and with the at least one further grinding disc, the stopper can be ground simultaneously. Hereby, the entire hollow shaft, which can be constructed for example as a camshaft, can be produced economically.

In a further advantageous embodiment, the grinding disc, the support disc and the ruler are divided in axial length into individual working segments, so that also a camshaft provided with cam lobes can be ground by the grinding method which has already been described. Here, in particular, the bearing sections situated between the cams are ground cylindrically. The cam lobes then dip into the withdrawn regions lying between the individual working segments. Thus, for example, cast camshafts or respectively prefabricated constructed camshafts, in particular camshafts with thermally joined, pressed-on cams or cams fastened by internal high pressure forming, can be processed.

The present invention is further based on the general idea of indicating an improved method for the external cylindrical grinding of hollow shafts, in particular for external cylindrical grinding of camshafts, in which firstly the hollow shaft which is to be ground is fixed on the face side between a centring and a centring stopper. Subsequently, at least one grinding disc and at least one support disc are delivered to the hollow shaft which is to be ground. During the grinding, a rotation axis of the hollow shaft is now held by means of a ruler at least by a distance of a>12 mm, in particular a>15-17 mm outside a plane defined by the rotation axis of the at least one grinding disc and the support disc. Through the comparatively great eccentricity, a particularly high-precision grinding can be achieved. This high-precision grinding can be achieved, moreover, in that it takes place through a synchronous delivery of the grinding disc, of the support disc and of the ruler, whereby consistent system parameters can be achieved.

Expediently, the hollow shaft which is to be ground is supported during the grinding by the support disc only over a length $l_1$ of 30-80% of the total length $l_2$ of the hollow shaft. In the same way, preferably the hollow shaft which is to be ground is supported during the grinding by the ruler likewise only over a length $l_1$ of 30-80% of the total length $l_2$ of the hollow shaft. Hereby, a necessary elasticity can be provided, which at least partially compensates the static overdetermination due to the grinding disc, the support disc and the ruler.

For the processing of camshafts with cam lobes, the grinding disc, the support disc and the ruler can be respectively withdrawn in the regions of the cam lobes, i.e. can have an annular groove, or else can be interrupted, i.e. can segmented in axial direction, in order to enable a grinding of the bearing surfaces situated between the cam lobes.

Further important features and advantages of the invention will emerge from the subclaims, from the drawings and from the associated figure description with the aid of the drawings.

It shall be understood that the features mentioned above and to be further explained below are able to be used not only in the respectively indicated combination, but also in other combinations or in isolation, without departing from the scope of the present invention.

Preferred example embodiments of the invention are illustrated in the drawings and are explained in further detail in the following description, wherein the same reference numbers refer to identical or similar or functionally identical components.

BRIEF DESCRIPTION OF THE DRAWINGS

The drawings show, respectively diagrammatically.

DETAILED DESCRIPTION

Figure 1:
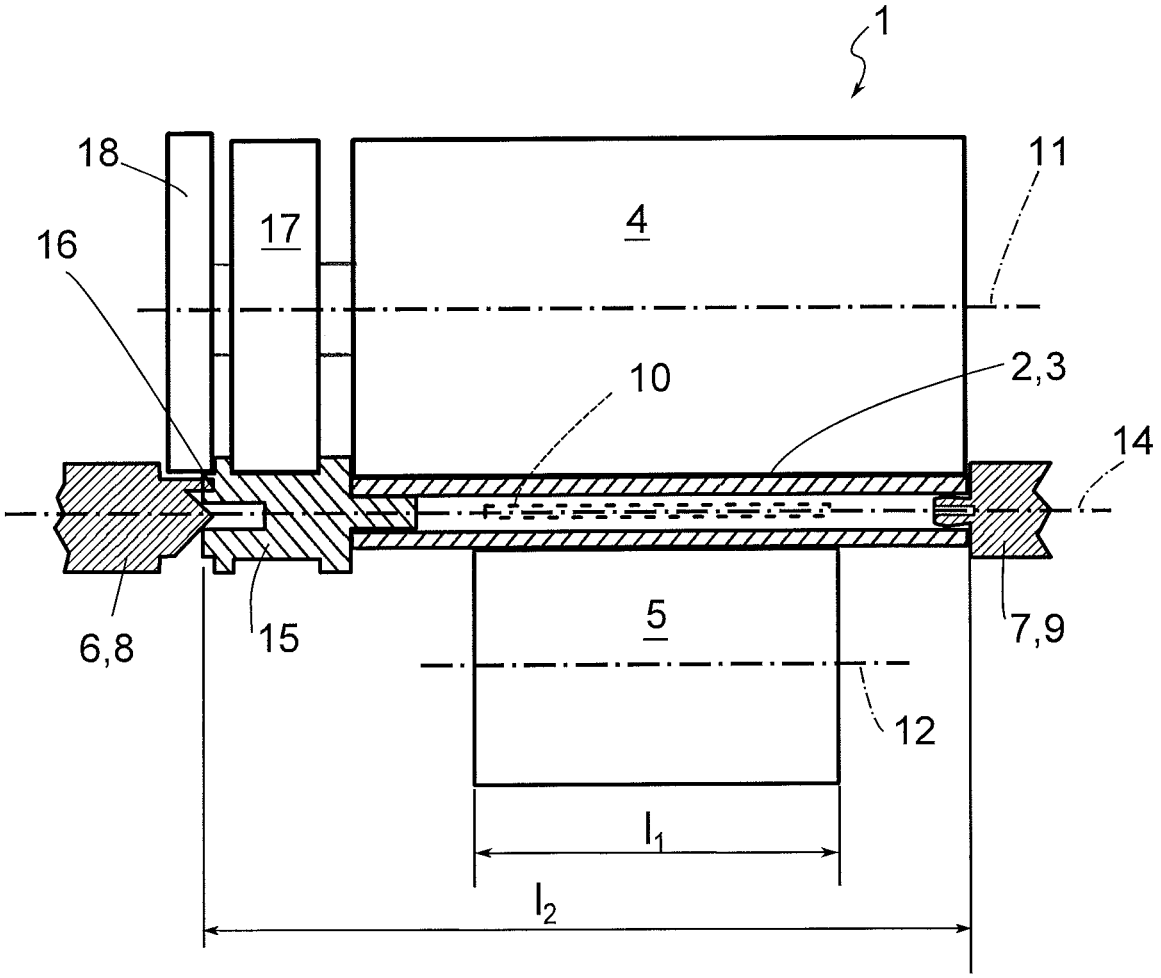
FIG. 1 a sectional illustration through a grinding machine according to the invention, with viewing direction from above, FIG. 2 a side view onto the grinding machine according to the invention, FIG. 3 an illustration as in FIG. 1, but with segmented grinding disc and support disc.
Figure 2:
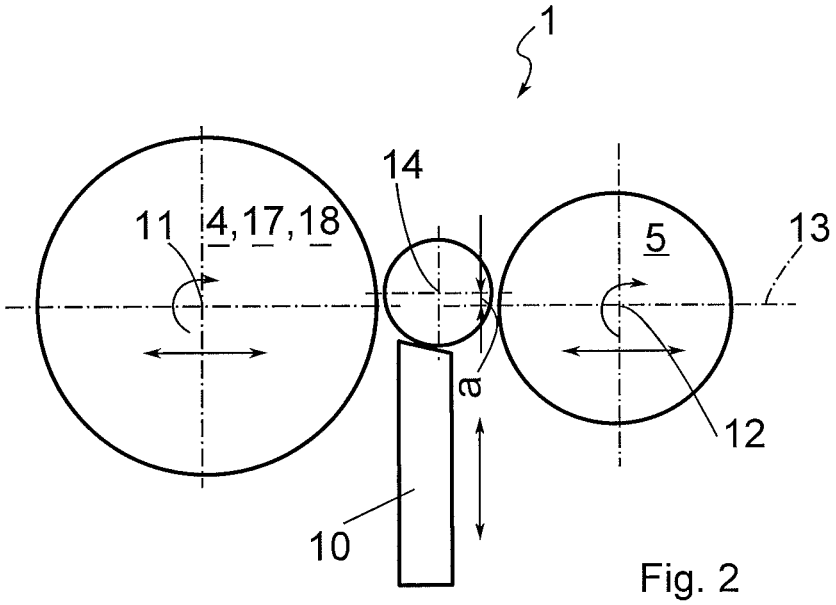
Figure 3:
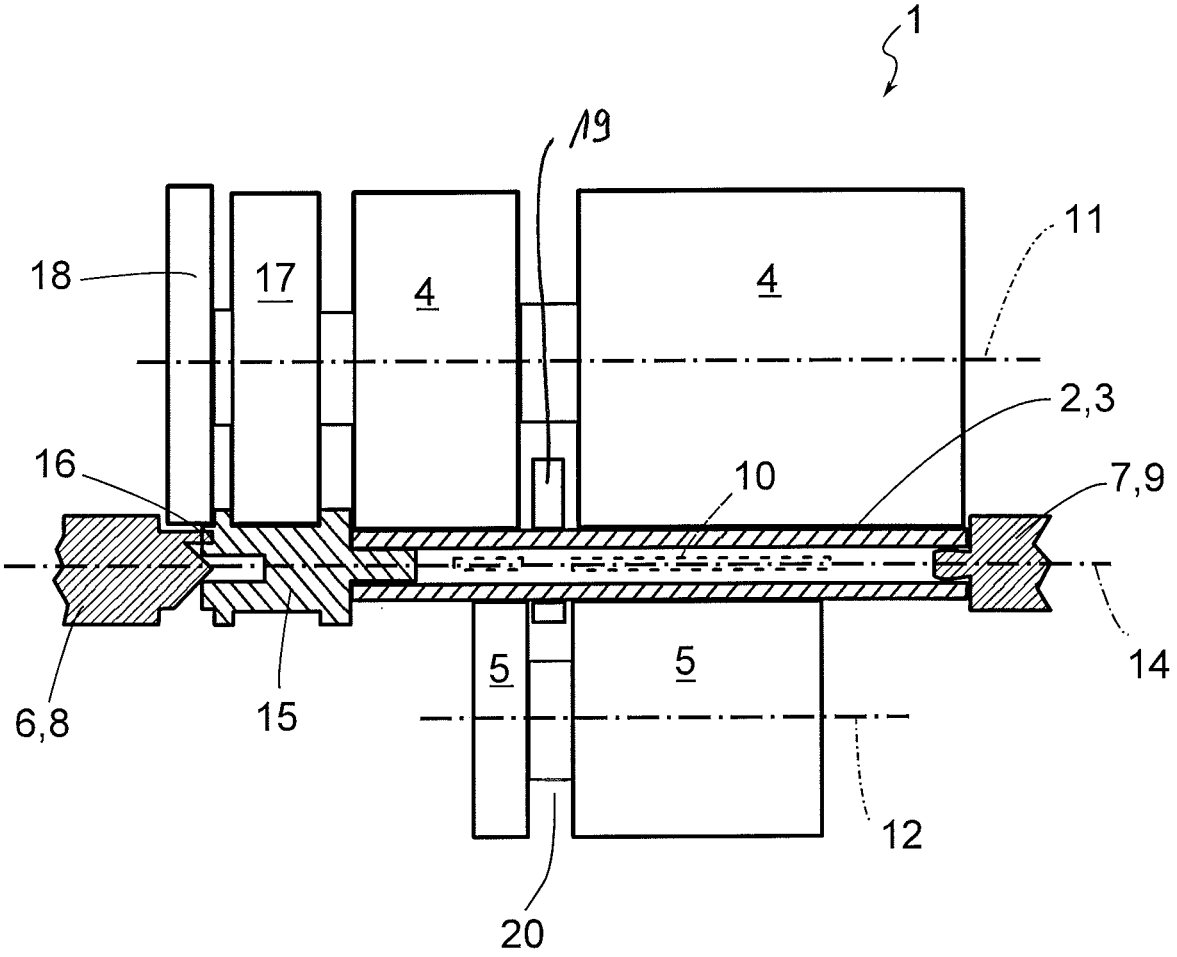

According to FIG. 1 to 3, a grinding machine 1 according to the invention for the external cylindrical grinding of hollow shafts 2, which are constructed for example as camshafts 3, has at least one grinding disc 4 with a circumferential grinding surface and one at least support disc 5. The hollow shaft 2 is fixed here between two face-side centrings 6, 7 during the grinding. According to the invention, the first centring 6 is constructed here as a point 8, whereas the opposite second centring 7 can be constructed as a centring stopper 9, which engages into the hollow shaft 2. Furthermore, a ruler 10 is provided for adjusting the position of the hollow shaft 2 before or respectively during the grinding. The grinding machine 1 according to the invention is, moreover, constructed such that a rotation axis 11 of the at least one grinding disc 4 and a rotation axis 12 of the support disc 5 are arranged parallel to one another and define a plane 13, wherein a rotation axis 14 of the hollow shaft 2 which is to be ground lies by a distance a greater than 15 mm outside the plane 13. Through the grinding machine 1 according to the invention, the hollow shaft 2 which is to be ground, in particular a camshaft 3, can be arranged between the grinding disc 4, the support disc 5 and the ruler 10, and in particular can be held by means of the ruler 10 by the distance a outside the plane 13 formed by the two rotation axes 11, 12, whereby a particularly high-precision grinding is made possible, in which the achieved roundness deviations, compared with grinding methods known hitherto, lie at only 50%.

Looking here at FIG. 2, it can be seen that the grinding disc 4 and the support disc 5 are able to be delivered substantially horizontally to the hollow shaft 2, whereas the ruler 10 is movable orthogonally to the plane 13 and therefore orthogonally to the grinding disc 4 and to the support disc 5. The grinding disc 4 and the support disc 5 rotate here in the same direction, i.e. clockwise in the present case, wherein the support disc 5 is usually not driven, but rather serves merely for the supporting of the hollow shaft 2 which is to be ground, during the grinding. In the present case, solely the hollow shaft 2 and the grinding disc 4 are driven.

As the grinding with the hollow shaft 2 with the grinding machine 1 according to the invention takes place by a simultaneous supporting of the hollow shaft 2, which is to be ground, by means of the grinding disc 4, the support disc 5 and the ruler 10, the system resulting herefrom is actually statically overdetermined. In order, however, to be able to give the system sufficient elasticity during the grinding process, the support of the hollow shaft 2, which is to be ground, by means of the support disc 5 takes place only on a limited axial length of the hollow shaft 2. It is conceivable here, for example, that the support disc 5 extends only over a length $l_1$ (cf. FIG. 1) of approximately 30-80% of the total length $l_2$ of the hollow shaft 2. The total length $l_2$ of the hollow shaft 2 comprises here not only the length of the hollow shaft 2 itself, but possibly also of a stopper 15 joined therewith, in so far as the latter is also to be ground simultaneously in the grinding machine 1. In the same way, of course, the ruler 10 can only extend over a length $l_1$ of approximately 30-80% of the total length $l_2$ of the hollow shaft 2, whereby a corresponding elasticity is made possible also in the direction of the ruler 10.

A drive of the hollow shaft 2 takes place here via the point 8, in particular via an axial contact pressure, or via a carrier 16 arranged at the point 8, which carrier cooperates in a form-fitting manner with the hollow shaft 2 or with a stopper 15 arranged thereon.

Additionally or alternatively, of course, a drive of the hollow shaft 2 can also take place via the centring stopper 9, in particular via an axial contact pressure, or via a carrier arranged at the centring stop 9, which carrier cooperates in a form-fitting manner with the hollow shaft 2 or with a stopper arranged thereon. Of course, it is also conceivable here that the centring stopper 9 is pressed into the hollow shaft 2 and thereby enables a torque transmission.

Looking again at FIG. 1, it can be seen that in addition to the grinding disc 4, a further grinding disc 17 is provided for the external cylindrical grinding of the stopper 15 joined with the hollow shaft 2. Of course, a third grinding disc 18 can also be provided. This makes it possible to finish-grind the entire hollow shaft 2, for example a camshaft, simultaneously and in one working step together with at least one stopper 15 and to do this with an extremely high precision which is able to be achieved by the grinding machine 1 according to the invention.

The external cylindrical grinding of the hollow shaft 2, in particular of a camshaft 3, takes place here as follows:

Firstly, the hollow shaft 2 which is to be ground is fixed on the face side between a point 8 and a centring stopper 9. Subsequently, the at least one grinding disc 4 and the support disc 5 are delivered, in particular horizontally, to the hollow shaft 2 which is to be ground. During the grinding of the hollow shaft 2, the latter is pushed upward by means of the ruler 10 such that its rotation axis 14 has a distance of a>12 mm, advantageously a>15-17 mm to a plane 13 defined by the axes 11 and 12. Through the eccentric holding of the hollow shaft 2 during the grinding process, a particularly precise grinding can be brought about. This is made possible by the holding in centrings 6, 7. The distance a here may, of course, not assume values of arbitrary size here, because otherwise the accuracies which are able to be achieved also decrease again starting from a certain distance a. Thereby, not only will a high concentricity be enabled, also of functional surfaces, such as threads, already present on the hollow shaft 2, but the axial alignment can also be improved enormously.

Looking at FIG. 3, it can be seen that a hollow camshaft 3 with at least one cam lobe 19 arranged thereon is ground in the grinding machine 1 according to the invention, wherein the at least one cam lobe 19 is arranged, during grinding, between two grinding discs 4 and two support discs 5. The two grinding discs 4 and the two support discs 5 are therefore segmented. Alternatively, the at least one cam lobe 19, during grinding, can also dip into an annular groove 20 of a profiled grinding disc 4 or support disc 5. Hereby, it is possible to grind bearing surfaces lying between the cam lobes 19. Also, such cam lobes 19 can of course be arranged between the grinding disc 4 and the further grinding disc 17, 18.

The invention claimed is:

1. A grinding machine for an external cylindrical grinding of hollow shafts, comprising:

at least one grinding disc with a circumferential grinding surface having a grinding disc rotation axis;

at least one support disc having a support disc rotation axis;

at least two centrings defining a shaft rotation axis and disposed axially opposite to one another with respect to the shaft rotation axis for a face-side fixing of a hollow shaft, the at least two centrings including a centring point and a centring stopper;

wherein the centring point has a pointed axial contact face and the centring stopper has a flat axial contact face disposed axially opposite to the pointed axial contact face along the shaft rotation axis for the face-side fixing of the hollow shaft, the flat axial contact face of the centring stopper extending perpendicularly to the shaft rotation axis for axially engaging against a respective face side of the hollow shaft;

a ruler structured and arranged to adjust a position of the hollow shaft and support the hollow shaft in a grinding position;

wherein the grinding disc rotation axis and the support disc rotation axis are arranged parallel to one another and define a plane, wherein the shaft rotation axis for the hollow shaft in the grinding position is disposed outside of the plane by a distance of a>12 mm;

wherein the centring point includes an axially projecting carrier disposed on the centring point radially offset from the pointed axial contact face to facilitate transmission of a rotational drive of the hollow shaft, and a further stopper is arranged at the centring point coaxially to the shaft rotation axis, the further stopper structured and arranged to engage into an inner diameter of the hollow shaft with a first axial end; and wherein the pointed axial contact face of the centring point engages with a second axial end of the further stopper along the shaft rotation axis and the axially projecting carrier cooperates in a form-fitting manner with a radial region of the second axial end of the further stopper.

2. The grinding machine according to claim 1, wherein the centring stopper has a stepped profile defining a first outer diameter and a second outer diameter smaller than the first outer diameter, the second outer diameter transitioning to the first outer diameter via the flat axial contact face, and wherein the second outer diameter of the centring stopper engages into the hollow shaft and radially contacts the inner diameter of the hollow shaft in the grinding position.

3. The grinding machine according to claim 1, wherein the distance of the shaft rotation axis from the plane is a>15 mm.

4. The grinding machine according to claim 1, wherein the at least one grinding disc and the at least one support disc are adjustable relative to the hollow shaft radially to the shaft rotation axis.

5. The grinding machine according to claim 1, wherein the ruler is movable orthogonally to the plane for displacing the hollow shaft.

6. The grinding machine according to claim 1, wherein the at least one grinding disc and the at least one support disc rotate in the same direction.

7. The grinding machine according to claim 1, wherein the centring point and the centring stopper define an axial spacing from one another in the grinding position of the hollow shaft corresponding to a total axial length of the hollow shaft, and wherein at least one of the at least one support disc and the ruler extends axially over a length of 30% to 80% of the total axial length of the hollow shaft.

8. The grinding machine according to claim 1, wherein the centring point rotatably drives the hollow shaft during grinding and transmits torque to the hollow shaft via the axially projecting carrier arranged at the centring point that cooperates with the further stopper.

9. The grinding machine according to claim 1, further comprising a further grinding disc with a circumferential grinding surface arranged to perform an external cylindrical grinding of the further stopper joined with the hollow shaft.

10. The grinding machine according to claim 1, wherein the shaft rotation axis is arranged parallel to the grinding disc rotation axis and to the support disc rotation axis.

11. The grinding machine according to claim 1, wherein the centring point and the centring stopper are aligned to one another relative to the shaft rotation axis in the grinding position.

12. The grinding machine according to claim 1, wherein the centring point and the centring stopper define an axial spacing from one another along the shaft rotation axis in the grinding position of the hollow shaft that corresponds to a total axial length of the hollow shaft, and wherein the at least one support disc extends over a limited axial length of 30% to 80% of the total axial length of the hollow shaft, and the at least one grinding disc extends entirely over the total axial length of the hollow shaft.

13. A method for an external cylindrical grinding of hollow shafts, comprising:

fixing a hollow shaft having a shaft rotation axis on axially opposite face sides of the hollow shaft between a point and a centring stopper, wherein the point engages into a further stopper joined with the hollow shaft, the further stopper having a first axial end joined with the hollow shaft and a second axial end engaged with the point, the centring stopper having a first section and a second section defining an outer diameter less than that of the first section, and wherein fixing the hollow shaft includes inserting the second section of the centring stopper into an interior of the hollow shaft such that the outer diameter of the second section radially engages an inner diameter of the hollow shaft;

delivering at least one grinding disc having a circumferential grinding surface and at least one support disc to the hollow shaft to be ground;

holding the hollow shaft between the point and the centring stopper during a grinding process while supporting the hollow shaft via a ruler in a grinding position where the shaft rotation axis is arranged at a distance of a>12 mm outside of a plane defined by a rotation axis of the at least one grinding disc and a rotation axis of the at least one support disc;

rotatably driving the hollow shaft via the point during the grinding process by transmitting torque to the hollow shaft via an axially projecting carrier disposed on the point radially offset from the shaft rotation axis, wherein the axially projecting carrier cooperates in at least one of form-fitting and force-fitting manner with a radial region of the second axial end of the further stopper arranged on the hollow shaft; and wherein inserting the second section of the centring stopper into the interior of the hollow shaft includes pressing a flat axial contact face of the centring stopper defined between the first section and the second section against a respective one of the face sides of the hollow shaft, the flat axial contact face extending perpendicularly to the shaft rotation axis to facilitate axially engaging against the respective one of the face sides for a face-side fixing of the hollow shaft.

14. The method according to claim 13, wherein holding the hollow shaft further includes supporting the hollow shaft during the grinding process with the at least one support disc extending over a limited axial length corresponding to 30% to 80% of a total axial length of the hollow shaft, and wherein the grinding process includes grinding the hollow shaft with the at least one grinding disc extending entirely over the total axial length of the hollow shaft.

15. The method according to claim 13, wherein the hollow shaft is a hollow camshaft, further comprising arranging at least one cam lobe thereon to be ground, wherein the at least one cam lobe is arranged, during grinding, between at least two grinding discs and at least two support discs.

16. The method according to claim 13, wherein the hollow shaft is a hollow camshaft, further comprising arranging at least one cam lobe thereon to be ground, wherein the at least one cam lobe is arranged to dip, during grinding, into at least one of an annular groove of the at least one grinding disc and an annular groove of the at least one support disc.

17. The method according to claim 13, further comprising rotatably driving the hollow shaft via the centring stopper during the grinding process and transmitting torque to the hollow shaft by imparting an axial contact pressure via centring stopper.

18. The method according to claim 13, wherein holding the hollow shaft between the point and the centring stopper during a grinding process includes grinding the hollow shaft via the at least one grinding disc in the grinding position with the point and the centring stopper coupled to the respective one of the face sides of the hollow shaft.

* * * * *